US006764394B2

(12) United States Patent
Sharifi et al.

(10) Patent No.: US 6,764,394 B2
(45) Date of Patent: Jul. 20, 2004

(54) EXTRACTION ARM

(75) Inventors: Assar Sharifi, Lyckelse (SE); Ambjorn Holmgren, Lyckelse (SE)

(73) Assignee: Plymovent AB, Lyckelse (SE)

( * ) Notice: Subject to any disclaimer, the term of this patent is extended or adjusted under 35 U.S.C. 154(b) by 0 days.

(21) Appl. No.: 10/472,045

(22) PCT Filed: Mar. 19, 2002

(86) PCT No.: PCT/SE02/00519

§ 371 (c)(1),
(2), (4) Date: Sep. 17, 2003

(87) PCT Pub. No.: WO02/074459

PCT Pub. Date: Sep. 26, 2002

(65) Prior Publication Data

US 2004/0082293 A1 Apr. 29, 2004

(30) Foreign Application Priority Data

Mar. 19, 2001 (SE) ..... 0100946

(51) Int. Cl.[7] ..... B08B 15/04
(52) U.S. Cl. ..... 454/64; 385/145.1; 454/65
(58) Field of Search ..... 454/64, 65, 63; 285/145.1, 145.4, 145.2

(56) References Cited

U.S. PATENT DOCUMENTS

| | | | | |
|---|---|---|---|---|
| 2,683,407 A | * | 7/1954 | Sigmund | 454/119 |
| 3,486,773 A | * | 12/1969 | Deplante | 285/121.7 |
| 4,158,462 A | | 6/1979 | Coral | |
| 5,482,505 A | | 1/1996 | Hedlund | |
| 5,738,148 A | * | 4/1998 | Coral et al. | 138/120 |

FOREIGN PATENT DOCUMENTS

| | | |
|---|---|---|
| DE | 296 15 870 | 3/1998 |
| SE | 506 015 | 11/1997 |

* cited by examiner

*Primary Examiner*—Harold Joyce
(74) *Attorney, Agent, or Firm*—Young & Thompson

(57) ABSTRACT

A telescopic extraction arm (1), having an outer tube (4) and an inner tube (6) displaceably and rotatably fitted therein. Via balancing rings (14, 16) fixed on each tube respectively, which are kept a pre-determinable distance apart by a stop member (18) arranged in the outer tube (4), the tubes can be easily displaced and locked in relation to one another with a negligible degree of the "drawer effect" occurring in conventional telescopic arrangements.

14 Claims, 3 Drawing Sheets

Fig. 1
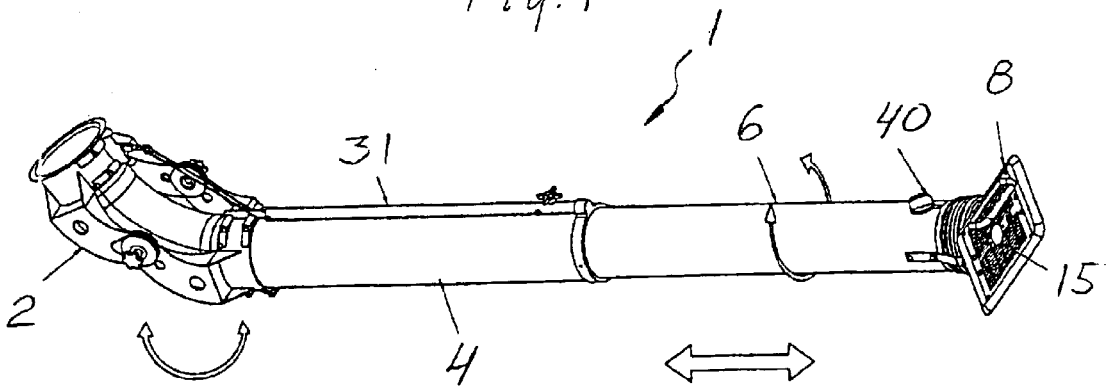
Fig. 2
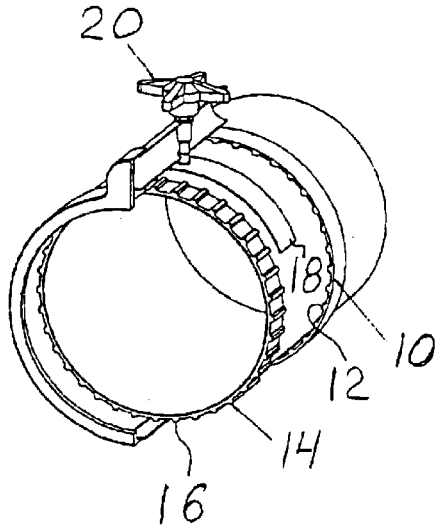
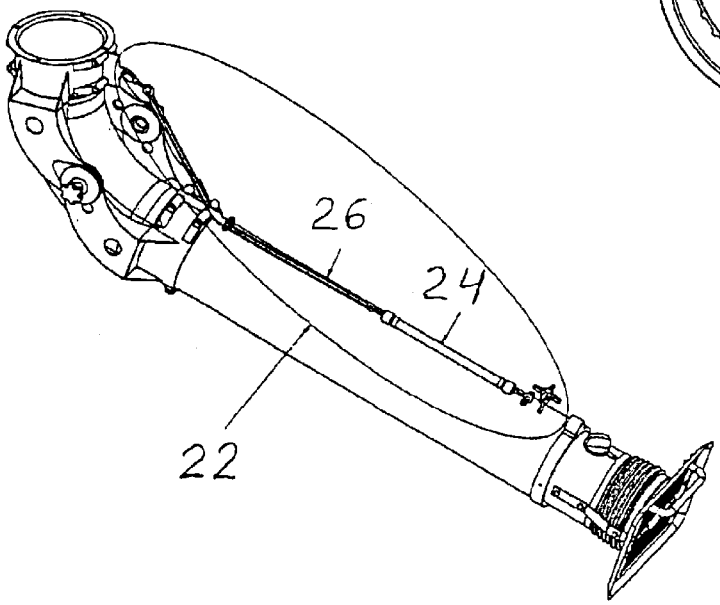
Fig. 3

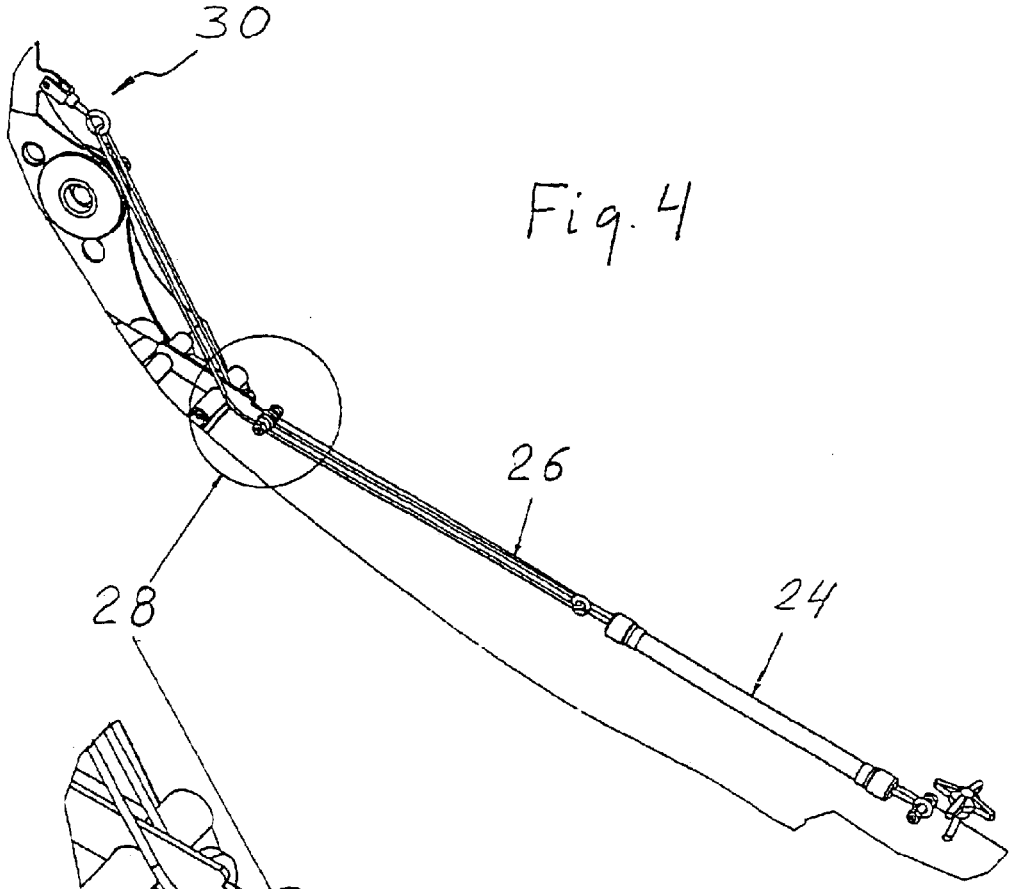
Fig. 4
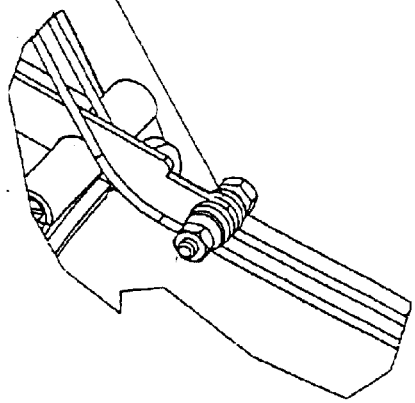
Fig. 5
Fig. 6
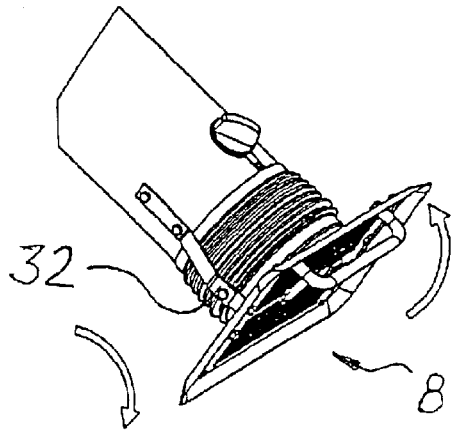

Fig. 7
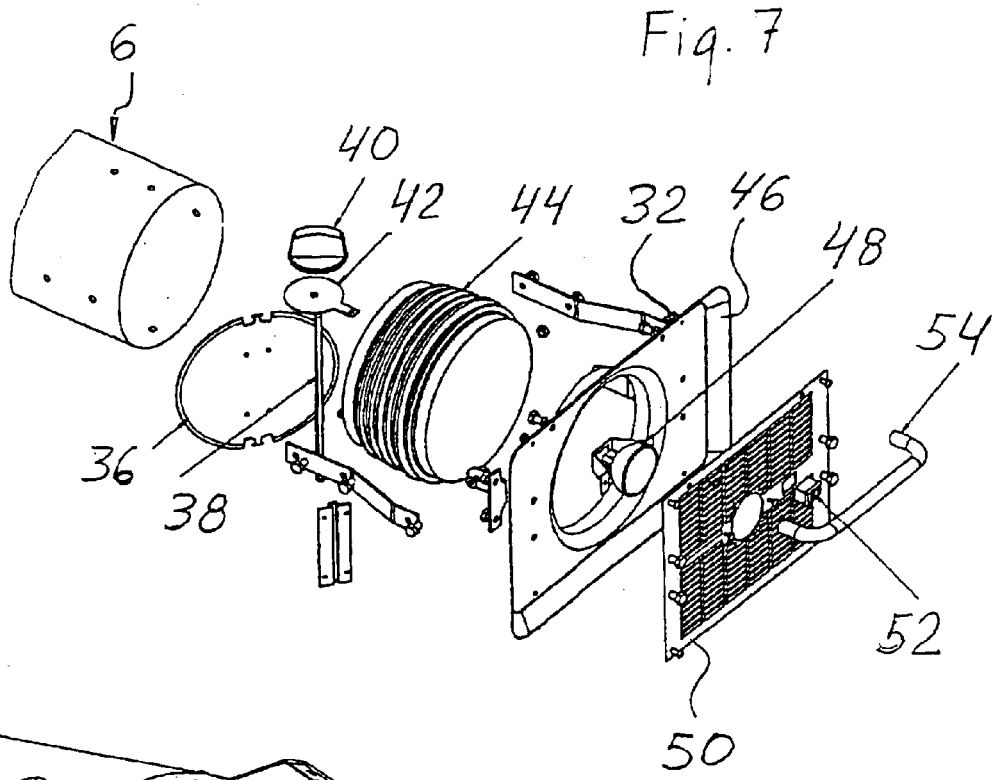
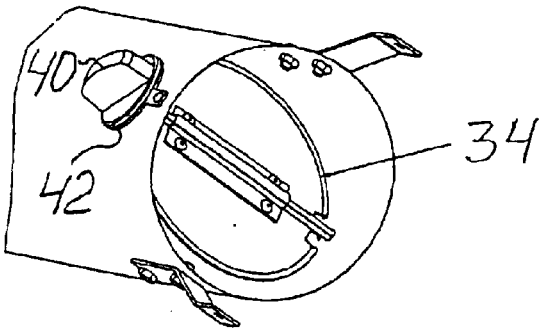
Fig. 8
Fig. 9
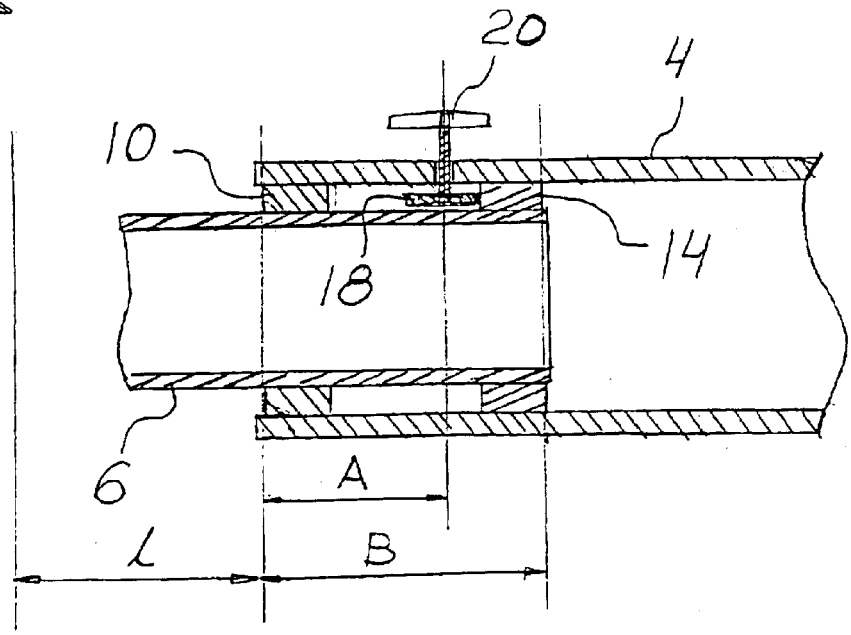

EXTRACTION ARM

The present invention relates to a telescopic extraction arm intended for use as localized extraction for welding fumes, powder, dust etc., specified in the preamble to. The arm may be used separately or may form part of systems, in which the extracted air passes through a filter arrangement before reaching an associated fan unit.

Previously known telescopic arrangements comprise two tubes, an outer tube and an inner tube moveable in relation to one another. The inner tube, arranged so that it can move inside the outer tube, is supported by a slide bearing sleeve situated at the outer end of the outer tube. The slide bearing sleeve is slotted over its entire length and can be partly fixed in the outer tube and partly secured against the inner tube by means of adjusting screws arranged in the outer tube. Owing to the longitudinal slotting, the sleeve is opened to a larger diameter in the event of torsional loading of the outer end of the inner tube and if the adjusting screws are at the same time screwed out. Due to the play in the opened slide bearing sleeve, the inner tube will be slanted in relation thereto, which means that the inner tube only bears against the edges of the slide bearing sleeve and a "drawer effect" occurs, making adjustment more difficult. Should the adjusting screws be screwed in on the other hand, the slide bearing sleeve will indeed be closed up and the diameter reduced, but the friction against the inner tube will at the same time increase, which likewise makes adjustment more difficult.

The object of the invention is to provide an extraction arm, which makes handling and adjustment of a suction device to selectable working positions within the space available easier than hitherto. This is feasible with an extraction arm of the generic type that has the characteristic features specified in the claims below. Preferred embodiments and advantageous developments and refinements to the invention will be evident from the description and the dependent claims.

The invention is described in more detail below with reference to the schematic drawing attached, which shows examples of a preferred embodiment.

FIG. 1 shows a perspective view of a telescopic arm with inner tube fully extended, FIG. 2 is a detailed, perspective view of slide rings and stop member for the extraction arm, FIG. 3 shows the telescopic arm according to FIG. 1 with inner tube fully retracted, FIG. 4 is a detailed view of a balancing arrangement fitted to the extraction arm, FIG. 5 shows a detail of the balancing arrangement to a larger scale, FIG. 6 is a detailed view showing the moveably suspended suction device of the extraction arm to a larger scale, FIG. 7 is an exploded drawing of the suction device and, FIG. 8 shows a throttle valve rotatably fitted at the outer end of the inner tube, FIG. 9 is a general drawing showing the positions of the first and second balancing rings in relation to one another, together with their relationship both to the outer end of the outer tube and to the position of the stop member.

The extraction arm shown in the drawing is generally denoted by the reference number 1 and has an intermediate joint 2 patented by the same applicant (including European patent 90908100.2- EP-B1 0467995, U.S. Pat. No. 5,211,602 and CA 2,051,101), which is intended to be fitted to an attachment, bracket or the like for connection to an extraction duct. An outer tube 4 is fixed in the intermediate joint 2, and an inner tube 6 is arranged in the outer tube in such a way that it is telescopically displaceable between a fully extended position (FIG. 1) and a fully retracted position (FIG. 3) relative to the outer tube 4. A moveable suction device or funnel 8, Which will be described in more detail later, is fitted at the outer end of the inner tube. In addition to the facility for telescopic displacement, the funnel 8 together with the inner tube 6 is also rotatable through 360° in relation to the outer tube 4. The adjustability of the extraction arm 1 is indicated by the double arrows in FIG. 1, whilst the tiltable suspension of the suction device 8 is indicated by the arrows in FIG. 6.

As FIG. 2 shows, the inner tube is guided in relation to the outer tube by means of a first balancing ring 10 with internal slide members 12, fixed close to the outer end of the outer tube 4 on the inside thereof, and a second balancing ring 14 with external slide members 16, fixed close to the inner end of the inner tube on the outside thereof. The balancing rings advantageously take the form of flexible toothed belts of any suitable friction-reducing material, such as plastic or metal, for example, which for forming the first and second balancing ring are oriented with teeth facing inwards and outwards respectively, so as to constitute the internal and external slide members respectively.

When the inner tube 6 is displaced or rotated relative to the outer tube 4, the tubes are guided or balanced in relation to one another by means of the slide members 12, 16, which means that the funnel 8 can, with relatively little force, be displaced or rotated into any desired position within the range of the extraction arm, according to the current requirement. The balancing rings 10, 14 reduce the risk of the "drawer effect" or eliminate it altogether, provided that the balancing rings are separated by a sufficiently large axial distance. A stop member in the form of a brake band 18, moveably fitted in the outer tube 4, is therefore moveably fitted at a first distance (A) from the outer end of the outer tube 4. The brake band can be adjustably applied, by means of an adjusting arrangement 20 with screw and handle, against the inner tube 6 in order to adjust the friction between the said parts. Regardless of whether the brake band 18 is applied against the inner tube 6 or is in the rest position close to the outside of the inner tube, the balancing ring 14 will bear against the latter, when the inner tube 6 is in its fully extended position. Experiments have shown that it is sufficient if the balancing rings are at a distance from one another corresponding to a second distance (B) greater than 150 mm and preferably not exceeding 500 mm, depending on the length (l) of the inner tube 6 and a torque (Nm) acting at its outer end. The second distance (B) is thus controlled by the first distance (A), that is to say the position of the stop member 18 relative to the outer end of the outer tube 4. In order to arrive at values for the second distance (B) suitable for an actual application, the value for the first distance is therefore correspondingly adjusted. The construction described reliably prevents the inner tube 6 being accidentally pulled out of the outer tube 4, whilst at the same time ensuring the value for the distance (A) that is required in order to avoid the "drawer effect".

FIG. 3 shows the telescopic arm according to FIG. 1 with inner tube fully retracted and a balancing arrangement 22 fitted to the extraction arm, which is shown in more detail in FIG. 4 and to a larger scale in FIG. 5. The balancing arrangement 22 comprises a resilient member 24, such as a multifibre rubber band, a tension spring or the like, which at one end is fixed to the adjusting arrangement 20 and at the other end is coupled to a cable arrangement 26, which via sheaves 28 runs to an attachment 30 arranged on the intermediate joint 2. The attachment 30 may be equipped, for example, with a tensioning arrangement for setting a pretension on the balancing arrangement that corresponds to a desired positional stability for current loading of the extraction arm. The balancing arrangement 22, as will be seen from FIG. 1, may be encapsulated in a tubular casing 31.

FIG. 6 is a detailed view showing the suction device 8 of the extraction arm, moveably suspended by way of a joint 32, to a larger scale, FIG. 7 is an exploded drawing of the suction device, which illustrates all the constituent parts, including a throttle valve 34, and FIG. 8 shows the throttle valve 34 rotatably fitted in the outer end of the inner tube. The suction device 8 comprises the throttle valve 34, which has a throttle blade 36 mounted on a throttle shaft 38, which is rotatably suspended close to the outer end of the inner tube 6. The throttle valve 34 can be adjusted, by means of a throttle knob 40 and knob stop 42, between a fully open and a closed position shutting off the inner tube. In the closed position the extraction arm can be compressed to its minimum length by means of the partial vacuum that is created by the fan arrangement connected to the system. The throttle knob 40 then constitutes a fixed stop towards the outer end of the outer tube 4. A flexible hose 44 connects the outer end of the inner tube to the actual funnel 46, which has external contours in the shape of a rectangle with rounded corners and an annular inlet to the hose 44. An accessory in the form of a working lingt 48 can be fitted at the center of the inlet if required. The working light can in that case be mounted in a grille 50, which is fitted in such a way that it cover the rectangular inlet of the funnel 46. The grille 50 may alternatively be designed to also cover the recess for the working light, in cases where separate linghting is to be used. A circuit-breaker 52 and an operating handle 54 are fitted to the funnel together with the grille.

What is claimed is:

1. An extraction arm (1) for a suction duct, the extraction arm (1) constituting a connection between a junction and a suction device of a localized extraction unit and comprising a telescopic arrangement having at least two tubes moveable in relation to one another, that is an outer tube (4) and an inner tube (6) arranged so that it can move inside the former, characterized in that an intermediate joint (2) connected to the junction is arranged so as to adjustably support the outer tube (4), that the inner tube (6) is supported inside the outer tube, partly by a first balancing ring (10) with internal slide members (12) situated close to the outer end of the outer tube and arranged in the outer tube (4), and partly by a second balancing ring (14) with external slide members (16) situated close to the inner end of the inner tube and arranged on the inner tube (6), that a stop member (18), moveably fitted in the outer tube (4) at a predetermined first distance (A) from the outer end thereof, is arranged between the balancing rings, against which stop member the balancing ring (14) of the inner tube comes to bear when the inner tube (6) is fully extended, and which stop member (18) ensures that the balancing rings (10, 14) are separated from one another at least by a second distance (B).

2. The extraction arm as claimed in claim 1, characterized in that the second distance (B) can vary depending on the length (l) of the inner tube (6) and a torque (Nm) acting at the outer end thereof.

3. The extraction arm as claimed in claim 1, characterized in that the stop member (18) is designed for adjustment of the friction between the stop member (18) and the inner tube (6).

4. The extraction arm as claimed in claim 1, characterized in that the stop member consists of a brake band (18), which can be adjustably applied against the inner tube (6).

5. The extraction arm as claimed in claim 1, characterized in that a balancing ring arrangement (22) is arranged with adjustable pre-tensioning in such a way that a set position of the arm (1) can be maintained for a selected load.

6. The extraction arm as claimed in claim 1, characterized in that the distance (B) can vary between 150 and 500 mm.

7. The extraction arm as claimed in claim 1, characterized in that the suction device (8) has a rectangular funnel (46), which is tiltably suspended by means of a joint (32).

8. The extraction arm as claimed in claim 1, characterized in that a working light (48) is arranged at the center of the inlet opening of the suction device (8).

9. The extraction arm as claimed in claim 8, characterized in that the working light (48) is mounted in a grille (50), which covers the inlet of the funnel (46).

10. The extraction arm as claimed in claim 9, characterized in that a circuit-breaker (52) and an operating handle (54) are fitted to the funnel.

11. The extraction arm as claimed in claim 2, characterized in that the stop member (18) is designed for adjustment of the friction between the stop member (18) and the inner tube (6).

12. The extraction arm as claimed in claim 2, characterized in that the stop member consists of a brake band (18), which can be adjustably applied against the inner tube (6).

13. The extraction arm as claimed in claim 3, characterized in that the stop member consists of a brake band (18), which can be adjustably applied against the inner tube (6).

14. The extraction arm as claimed in claim 11, characterized in that the stop member consists of a brake band (18), which can be adjustably applied against the inner tube (6).

* * * * *